US009246212B2

(12) United States Patent
Varjonen

(10) Patent No.: US 9,246,212 B2
(45) Date of Patent: Jan. 26, 2016

(54) APPARATUS COMPRISING AN ANTENNA ELEMENT AND A METAL PART

(75) Inventor: Eero Oskari Varjonen, Turku (FI)

(73) Assignee: Nokia Technologies Oy, Espoo (FI)

( * ) Notice: Subject to any disclaimer, the term of this patent is extended or adjusted under 35 U.S.C. 154(b) by 497 days.

(21) Appl. No.: 12/448,391

(22) PCT Filed: Dec. 22, 2006

(86) PCT No.: PCT/IB2006/004180
§ 371 (c)(1),
(2), (4) Date: Jun. 17, 2009

(87) PCT Pub. No.: WO2008/078144
PCT Pub. Date: Jul. 3, 2008

(65) Prior Publication Data
US 2010/0007563 A1 Jan. 14, 2010

(51) Int. Cl.
*H01Q 1/24* (2006.01)
*H01Q 1/48* (2006.01)
*H01Q 1/52* (2006.01)

(52) U.S. Cl.
CPC ..... *H01Q 1/243* (2013.01); *H01Q 1/48* (2013.01); *H01Q 1/52* (2013.01); *Y10T 29/49018* (2015.01)

(58) Field of Classification Search
CPC ..... H01Q 1/243; H01Q 1/242
USPC ..... 343/702, 700 MS, 725, 729, 841, 846
See application file for complete search history.

(56) References Cited

U.S. PATENT DOCUMENTS

| | | | | |
|---|---|---|---|---|
| 5,977,917 | A * | 11/1999 | Hirose | 343/702 |
| 6,140,966 | A | 10/2000 | Pankinaho | 343/700 |
| 6,266,019 | B1 | 7/2001 | Stewart et al. | 343/702 |
| 6,369,761 | B1 * | 4/2002 | Thiam et al. | 343/700 MS |
| 6,421,016 | B1 * | 7/2002 | Phillips | H01Q 1/245 343/702 |
| 6,566,984 | B2 * | 5/2003 | Niiranen et al. | 333/202 |
| 6,784,767 | B2 * | 8/2004 | Hiroshima et al. | 333/206 |
| 7,138,954 | B2 * | 11/2006 | Schillmeier et al. | 343/795 |
| 7,471,247 | B2 * | 12/2008 | Saily et al. | 343/700 MS |
| 7,688,267 | B2 * | 3/2010 | Hill | 343/702 |
| 7,764,236 | B2 * | 7/2010 | Hill et al. | 343/702 |
| 2003/0098813 | A1 | 5/2003 | Koskiniemi et al. | 343/702 |
| 2003/0174092 | A1 * | 9/2003 | Sullivan et al. | 343/702 |
| 2004/0032371 | A1 * | 2/2004 | Mendolia | H01Q 1/243 343/702 |
| 2005/0026660 | A1 | 2/2005 | Park et al. | 455/575.5 |
| 2006/0256017 | A1 * | 11/2006 | Ishizaki | 343/700 MS |
| 2010/0144292 | A1 * | 6/2010 | Kim | 455/129 |

FOREIGN PATENT DOCUMENTS

| | | | |
|---|---|---|---|
| DE | 1 261 571 | | 2/1968 |
| EP | 1 320 147 | A1 | 6/2003 |
| EP | 1 078 415 | B1 | 6/2004 |
| EP | 1 469 550 | A2 | 10/2004 |
| GB | 2 390 240 | A | 12/2003 |
| JP | 2003273767 | A | 9/2003 |
| JP | 2004040524 | A | 2/2004 |
| WO | WO-2005074070 | A1 | 8/2005 |

* cited by examiner

*Primary Examiner* — Dameon E Levi
*Assistant Examiner* — Hasan Islam
(74) *Attorney, Agent, or Firm* — Harrington & Smith

(57) ABSTRACT

An apparatus including an antenna element; a metal part; a ground; and a filter connected between the metal part and the ground that has a frequency dependent impedance.

20 Claims, 1 Drawing Sheet

APPARATUS COMPRISING AN ANTENNA ELEMENT AND A METAL PART

FIELD OF THE INVENTION

Embodiments of the present invention relate to an apparatus comprising an antenna element and a metal part.

BACKGROUND TO THE INVENTION

A radio communications apparatus comprises an antenna element for transmitting and/or receiving radio signals. It may also comprise a metal part, separate to the antenna element, that is provided for a function unconnected with the operation of the antenna element. The metal part may be, for example, an electromagnetic shield for shielding of electronic components, a structural support element such as a chassis or frame, part of an integrated component such as battery cell etc.

The presence of the metal part may affect the operational characteristics of the antenna element because of electromagnetic coupling.

One approach to this problem is to electrically isolate the metal part to suppress electric currents flowing within the part. A disadvantage of this approach is that the metal part may become electro-statically charged.

Another approach to this problem is to ground the metal part.

BRIEF DESCRIPTION OF THE INVENTION

The inventors have realized that the grounding topology chosen for a metal part may affect the performance of the antenna element. This problem is compounded if the antenna element is a multi-band antenna element as a satisfactory solution for one band may be unsatisfactory for other bands. It would therefore be desirable to provide more design freedom in creating an effective grounding topology for a metal part.

According to one embodiment of the invention there is provided an apparatus comprising: an antenna element; a metal part; a ground; and a filter connected between the metal part and the ground that has a frequency dependent impedance.

According to another embodiment of the invention there is provided a method of assembling an apparatus comprising a radiating antenna element, the method comprising: electrically interconnecting a metal part, separate to the antenna element, and a ground via a filter that has a frequency dependent impedance.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1A:
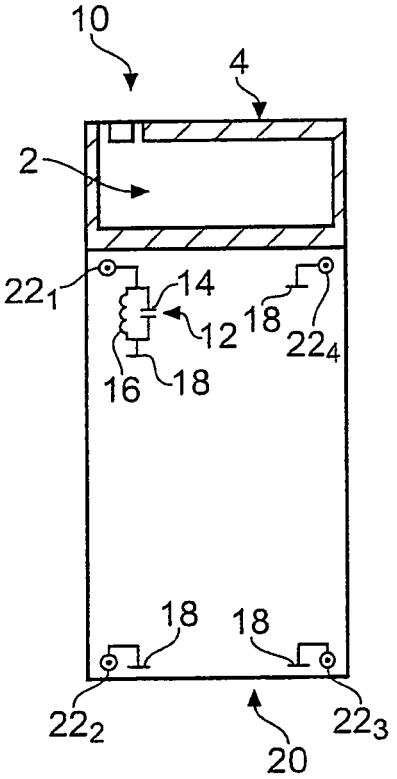
FIG. 1A is a plan view of an apparatus that grounds a metal part via a filter 12 that has a frequency dependent impedance.
Figure 1B:
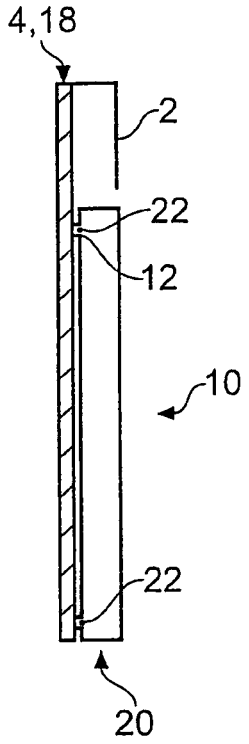
FIG. 1B is a side view of the apparatus.
Figure 1C:
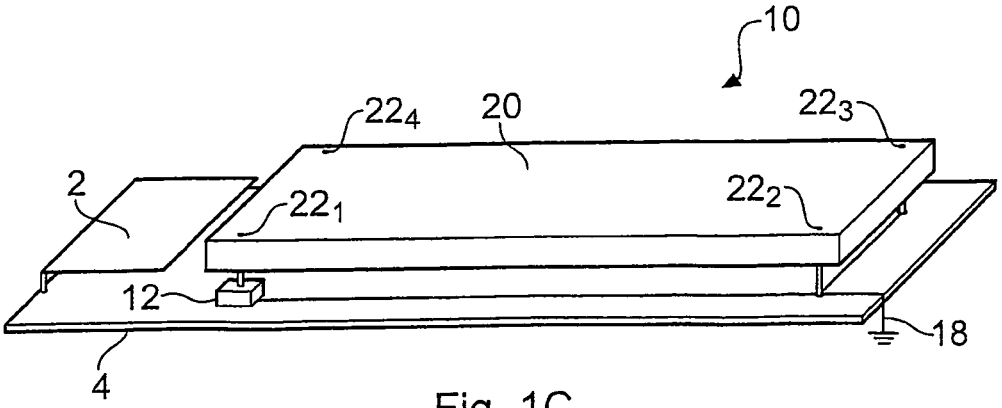
FIG. 1C is a perspective side-top view of the apparatus.

FIGS. 1A, 1B and 1C illustrate an apparatus 10 that comprises an antenna element 2, a metal part 20, a ground 18 and a filter 12 connected between the metal part 20 and the ground 18 that has a frequency dependent impedance.

FIG. 1A is a plan view of the apparatus 10, FIG. 1B is a side view of the apparatus 10 and FIG. 1C is a perspective side-top view of the apparatus 10.

In the illustrated example, the antenna element 2 is a multi-band radio frequency radiator element having operational bands including at least a first frequency band of operation and a second, different, frequency band of operation.

The ground plane 4 is provided by a printed wiring board (PWB) 4 which extends under and adjacent to the antenna element 2 and also the metal part 20. The metal part 20 is physically and functionally separate and distinct from the antenna element 2 and typically performs some other function. It may, for example, be decorative trimming, a battery casing or electromagnetic shielding or a support for a keypad or some other supporting chassis element.

The metal part 20 is electrically connected at different points via electrical connectors $\mathbf{22}_n$ to a ground 18 provided by the underlying ground plane (PWB) 4. The electrical connectors 22 provide a galvanic dc current path from the metal part 20 to the ground 18. Although multiple connectors are illustrated, in other embodiments a single connector may be used.

At least one of the current paths between the metal part 20 and the ground plane 4 incorporates a filter 12 that has a frequency dependent impedance. The frequency dependent impedance is arranged to be relatively low at one or more of the operational bands of the antenna element 2 and relatively high for the other operational band or bands of the antenna element 2.

The filter may operate as a band-stop filter in that it has a very high impedance for one (or more) of the operational bands of the antenna element 2 but not the other or other operational bands. It will be appreciated that filters other than band-stop filters may be used and that any form of filter network may be appropriate.

In the illustrated example, the filter 12 is a parallel LC filter that comprises a capacitor 14 connected in parallel with an inductor 16 between ground 18 and the metal part 20. The capacitor 14 and the inductor 16, in this example, are discrete components which have values chosen so that the resonant frequency $\omega_o$ of the LC circuit corresponds to the second frequency band of the antenna element 2. As is known to those skilled in the art, the effective impedance of the parallel LC filter 12 becomes very large at the resonant frequency $\omega_o = (LC)^{-1/2}$. Consequently, at the resonant frequency (the second frequency band of the antenna element 2) the metal part 20 that is connected to ground 18 via the filter 12 becomes decoupled from the ground 18 because of the filter's very high impedance. However, at a lower frequency (e.g. the first frequency band) the metal part 20 remains electrically coupled to the ground 18 via the inductor 16.

The parallel LC filter 12 provides a permanent dc current path to ground from the metal part 20, which prevents electrostatic charge accumulating at the metal part 20.

It will therefore be appreciated that the current paths to ground for the first frequency band include current paths via the electrical connectors $\mathbf{22}_1$, $\mathbf{22}_2$, $\mathbf{22}_3$ and $\mathbf{22}_4$. However, at the second, higher, frequency band the current paths to ground include paths via the electrical connectors $\mathbf{22}_2$, $\mathbf{22}_3$ and $\mathbf{22}_4$ but do not include a path via the electrical connector $\mathbf{22}_1$.

It will be appreciated that any number of electrical connectors 22 may be used to provide separate current paths to the ground 18 provided by the PWB 4 from the metal part 20 and that some, or all, of these current paths may include within them a filter 12. The same or different filters may be used in the respective current paths. The filters may, for example, be band-stop filters with stops at the same or different operational frequency bands.

In some embodiments, the connectors 22 which are used to make electrical connection between the ground 18 provided by the PWB 4 and the metal part 20 may also be used to secure, that is fix, the metal part 20 to the PWB 4. For example, the electrical connectors 22 may be provided by screws that screw parts of the metal part 20 into grounded portions of the PWB 4.

Apparatus 10 may be any type of radio transmission or reception device or a module for such a device. It may for example be a personal electronic device that is hand-portable such as, for example, a mobile cellular telephone.

The antenna element 2 may have operational bandwidths (low insertion loss S11) for different radio frequency bandwidths. As an example, the first frequency band of operation may include one or more of US-GSM 850 (824-894 MHz) and EGSM 900 (880-960 MHz) and the second frequency band of operation may include one or more of PCN/DCS1800 (1710-1880 MHz), US-WCDMA1900 (1850-1990), WCDMA2100 (Tx: 1920-19801 Rx: 2110-2180) and PCS1900 (1850-1990 MHz). These bands represent current cellular telecommunication radio frequency bands. In other embodiments one or both of the operational frequency bands may relate to other radio frequency bands such as the band for Wireless Local Area Networking (WLAN) and Bluetooth or the bands for mobile radio or television.

In the illustrated example, the antenna element 2 is a monopole antenna element—a Planer Inverted F Antenna (PIFA) that overlies an adjacent ground plane 4. Although a particular monopole antenna is illustrated, other monopole antenna elements may be used. One type of monopole is an inverted F antenna (IFA). It typically does not overlie a ground plane. Another type of monopole is an external retractable monopole. It also does not overlie a ground plane. Types of antenna elements other than monoples may also be used such as dipoles, slots, waveguides etc. The antenna element 2 may be an element for an internal antenna as illustrated in FIGS. 1A, 1B and 1C or may be an element for an external antenna.

Although embodiments of the present invention have been described in the preceding paragraphs with reference to various examples, it should be appreciated that modifications to the examples given can be made without departing from the scope of the invention as claimed. For example, although the embodiments of the invention have been described for the sake of clarity as having a single metal part, it should be understood that this limitation is not a technical limitation and the apparatus 10 may have multiple grounded metal parts each of which may have one or more current paths to ground some or all of which may be via filter networks.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

an antenna element;

a ground;

a metal part having non-antenna related functionality and configured to be non-moveable relative to the ground;

a plurality of conductive connections providing galvanic dc current paths between the metal part and the ground; and a further conductive connection comprising a filter electrically interconnected between the metal part and the ground wherein the filter is a band-stop filter having a very high impedance at a particular frequency band.

2. An apparatus as claimed in claim 1, wherein the filter comprises a parallel LC circuit.

3. An apparatus as claimed in claim 2, wherein the parallel LC circuit comprises discrete components.

4. An apparatus as claimed in claim 1, wherein said further conductive connection is one of multiple conductive connections between the metal part and the ground which incorporate a filter.

5. An apparatus as claimed in claim 1, wherein the conductive connection nearest the antenna element comprises the filter.

6. An apparatus as claimed in claim 1, wherein the conductive connections are provided by connectors that connect the metal part to a grounded printed wiring board.

7. An apparatus as claimed in claim 1, wherein the antenna element is a monopole antenna element.

8. An apparatus as claimed in claim 1, wherein the antenna element is positioned adjacent a ground plane that provides the ground.

9. An apparatus as claimed in claim 1, wherein the antenna element is a multi band antenna element having a first frequency band of operation and a second, different, frequency band of operation.

10. An apparatus as claimed in claim 9, wherein the filter is tuned to the second frequency band.

11. An apparatus as claimed in claim 9, wherein the filter is a band-stop filter having a very high impedance at the second frequency band.

12. An apparatus as claimed in claim 1, wherein the metal part is any one of a supporting chassis, an electromagnetic shield, a frame, a component part, a decorative trimming, a battery casing or a support for a keypad.

13. An apparatus as claimed in claim 1 embodied as a module for a radio communication device or embodied as a radio communication device.

14. A personal electronic device incorporating the apparatus as claimed in claim 1.

15. A method comprising:

providing an antenna element; and electrically interconnecting a metal part having non-antenna related functionality and a ground via a filter and via a plurality of conductive connections to provide galvanic dc current paths between the metal part and the ground, wherein the metal part is configured to be non-moveable relative to the ground and wherein the filter is a band-stop filter having a very high impedance at a particular frequency band.

16. An apparatus as claimed in claim 4, wherein the apparatus comprises a plurality of separate filters having frequency dependent impedances and a plurality of the conductive connections provides a separate current path to ground via the plurality of separate filters.

17. An apparatus as claimed in claim 1 wherein the filter provides a permanent direct current path to ground from the metal part.

18. The method according to claim 15 wherein providing an antenna element comprises providing a multi band antenna element having a first frequency band of operation and a second, different, frequency band of operation.

19. The method according to claim 15 wherein said electrically interconnecting comprises electrically interconnecting the metal part and the ground via a plurality of conductive connections which incorporate a filter.

20. An apparatus as claimed in claim 15 wherein the antenna element is a multi band antenna element having a first frequency band of operation and a second, different, frequency band of operation, the band-stop filter has a very high impedance at the second frequency band of operation and is tuned to the second frequency band of operation.

* * * * *